US005442384A

United States Patent [19]

Schantz et al.

[11] Patent Number: 5,442,384

[45] Date of Patent: Aug. 15, 1995

[54] INTEGRATED NOZZLE MEMBER AND TAB CIRCUIT FOR INKJET PRINTHEAD

[75] Inventors: Christopher A. Schantz, Foster City; Eric G. Hanson, Burlingame; Si Ty, Pleassanton, all of Calif.; Paul H. McClelland, Monmouth, Oreg.; William J. Lloyd, Pigeon, Mich.; Winthrop D. Childers, San Diego, Calif.

[73] Assignee: Hewlett-Packard Company, Palo Alto, Calif.

[21] Appl. No.: 139,630

[22] Filed: Oct. 19, 1993

Related U.S. Application Data

[63] Continuation of Ser. No. 862,668, Apr. 2, 1992, which is a continuation-in-part of Ser. No. 849,650, Mar. 9, 1992, Pat. No. 5,305,018, which is a continuation of Ser. No. 568,000, Aug. 16, 1990, abandoned.

[51] Int. Cl.[6] ..... B41J 2/035; B41J 2/05

[52] U.S. Cl. ..... 347/20; 347/40; 347/55

[58] Field of Search ..... 346/1.1, 140 R; 347/20, 347/29, 40, 44–48, 50, 55, 56

[56] References Cited

U.S. PATENT DOCUMENTS

| | | | |
|---|---|---|---|
| 3,949,410 | 4/1976 | Bassous et al. | 346/75 |
| 4,312,009 | 1/1982 | Lange et al. | 346/140 R |
| 4,450,455 | 5/1984 | Sugitani et al. | 346/140 R |
| 4,490,728 | 12/1984 | Vaught et al. | 346/1.1 |
| 4,500,326 | 10/1985 | Allen et al. | 346/140 R |
| 4,500,895 | 2/1985 | Buck et al. | 346/140 R |
| 4,502,060 | 2/1985 | Rankin et al. | 346/140 |
| 4,530,464 | 7/1985 | Yamamoto et al. | 239/102 |
| 4,558,333 | 12/1985 | Sugitani et al. | 346/140 R |
| 4,568,953 | 2/1986 | Aoki et al. | 346/140 |
| 4,580,149 | 4/1986 | Domoto et al. | 346/140 |
| 4,587,534 | 5/1986 | Saito et al. | 346/140 R |
| 4,595,938 | 6/1986 | Conta et al. | 346/140 R |
| 4,611,219 | 9/1986 | Sugitani et al. | 346/140 R |
| 4,683,481 | 7/1987 | Johnson | 346/140 R |
| 4,695,854 | 9/1987 | Cruz-Uribe | 346/140 |
| 4,712,172 | 12/1987 | Kiyohara et al. | 346/1.1 |
| 4,734,717 | 3/1988 | Rayfield | 346/140 |
| 4,746,935 | 5/1988 | Allen | 346/140 |

(List continued on next page.)

FOREIGN PATENT DOCUMENTS

| | | | |
|---|---|---|---|
| 0309146A2 | 3/1989 | European Pat. Off. | 346/140 PD |
| 0367541A2 | 5/1990 | European Pat. Off. . | |
| 62-170350 | 7/1987 | Japan | B41J 3/04 |
| WO91/08111 | 6/1991 | WIPO . | |

OTHER PUBLICATIONS

Gary L. Seiwell et al., "The ThinkJet Orifice Plate: A Part With Many Functions," May 1985, Hewlett Packard Journal, pp. 33–37.

J. I. Crowley et al., "Nozzles for Ink Jet Printers," IBM Technical Disclosure Bulletin, vol. 25, No. 8, Jan. 1983.

J. T. C. Yeh, "Laser Ablation of Polymers," J. Vac. Sci. Tech. May/Jun. 1986, pp. 653–658.

Thomas A. Znotins et al., "Excimer Lasers: An Emerging Technology in Materials Processing," Laser Focus Electro Optics, May 1987, pp. 54–70.

V. Srinivasan, et al., "Excimer Laser Etching of Polymers," Department of Chemical Engineering, Clarkson University, Potsdam, N.Y., received Dec. 30, 1985; accepted for publication, Feb. 19, 1986.

(List continued on next page.)

*Primary Examiner*—A. T. Grimley
*Assistant Examiner*—Thu A. Dang
*Attorney, Agent, or Firm*—Dennis G. Stenstrom

[57] ABSTRACT

In one of the preferred embodiments, an inkjet printhead includes a nozzle member formed of a polymer material that has been laser-ablated to form inkjet orifices. The nozzle member also has formed on it conductive traces for supplying electrical signals to heating elements on a substrate mounted to a surface of the nozzle member. In a preferred method, the orifices are formed by Excimer laser ablation.

6 Claims, 7 Drawing Sheets

U.S. PATENT DOCUMENTS

| | | | |
|---|---|---|---|
| 4,773,971 | 9/1988 | Lam et al. | 204/11 |
| 4,780,177 | 10/1988 | Wojnarowski et al. | 156/643 |
| 4,801,954 | 1/1989 | Miura et al. | 346/140 R |
| 4,801,955 | 1/1989 | Miura et al. | 346/140 R |
| 4,829,319 | 5/1989 | Chan et al. | 346/1.1 |
| 4,842,677 | 6/1989 | Wojnarowski et al. | 156/643 |
| 4,847,630 | 7/1989 | Bhaskar et al. | 346/1.1 |
| 4,890,126 | 12/1989 | Hotomi | 346/140 R |
| 4,905,017 | 2/1990 | Sugitani et al. | 346/1.1 |
| 4,915,981 | 4/1990 | Traskos et al. | 427/53.1 |
| 4,926,197 | 5/1990 | Childers et al. | 346/140 R |
| 4,942,408 | 7/1990 | Braun | 346/140 |
| 4,965,608 | 10/1990 | Shinohara et al. | 346/1.1 |
| 5,016,024 | 5/1991 | Lam et al. | 346/1.1 |
| 5,059,989 | 10/1991 | Eldridge et al. | 346/140 R |
| 5,068,006 | 11/1991 | Fisher | 156/633 |
| 5,132,707 | 7/1992 | O'Neill | 346/140 R |
| 5,148,185 | 9/1992 | Abe et al. | 346/1.1 |
| 5,163,177 | 11/1992 | Komura | 346/1.1 |
| 5,189,437 | 2/1993 | Michaelis et al. | 346/1.1 |

OTHER PUBLICATIONS

W. Childers, et al. "An Ink Jet Print Head Having Two Cured Photoimaged Barrier Layers," Copending Appln. Ser. No. 07/679,378 filed Apr. 2, 1991, 29 pages.

R. Srinivasan et al., "Self-Developing Photoetching of Poly(ethylene terephthalate) Films by Far-Ultraviolet Excimer Laser Radiation," IBM Thomas J. Watson Research Center, Yorktown Heights, N.Y.; received May 10, 1982; accepted for publication Jul. 2, 1982.

R. Srinivasan, "Kinetics of the Ablative Photodecomposition of Organic Polymers in the Far Ultraviolet," IBM Thomas J. Watson Research Center, Yorktown Heights, N.Y.; received Mar. 21, 1983; accepted for publication Jun. 24, 1983.

Nielsen, Niels J., "History of Thinkjet Printhead Development," Hewlett-Packard Journal, May 1985, pp. 4-7.

INTEGRATED NOZZLE MEMBER AND TAB CIRCUIT FOR INKJET PRINTHEAD

CROSS REFERENCE TO RELATED APPLICATION

This is a continuation of copending application Ser. No. 07/862,668, filed on Apr. 2, 1992, which is a CIP of Ser. No. 07/849,650, filed Mar. 9, 1992, now U.S. Pat. No. 5,305,018; which is a continuation of Ser. No. 07/568,000, filed Aug. 16, 1990, now abandoned.

This application is a continuation-in-part application of application Ser. No. 07/568,000 filed Aug. 16, 1990, entitled "Photo-ablated Components for Inkjet Printhead."

This application relates to the subject matter disclosed in the following United States patent and copending United States applications:

U.S. Pat. No. 4,926,197 to Childers, entitled "Plastic Substrate for Thermal Ink Jet Printer;"

U.S. application Ser. No. 06/864,889, filed herewith, entitled "Laser Ablated Nozzle Member For Inkjet Printhead;"

U.S. application Ser. No. 07/862,669, filed herewith, entitled "Nozzle Member Including Ink Flow Channels;"

U.S. application Ser. No. 07/864,822, filed herewith, entitled "Improved Inkjet Printhead;"

U.S. application Ser. No. 07/862,086, filed herewith, entitled "Improved Ink Delivery System for an Inkjet Printhead;"

U.S. application Ser. No. 07/864,930, filed herewith, entitled "Structure and Method for Aligning a Substrate With Respect to Orifices in an Inkjet Printhead;"

U.S. application Ser. No. 07/864,896, filed herewith, entitled "Adhesive Seal for an Inkjet Printhead;"

U.S. application Ser. No. 07/862,667, filed herewith, entitled "Efficient Conductor Routing for an Inkjet Printhead;"

U.S. application Ser. No. 07/864,890, filed herewith, entitled "Wide Inkjet Printhead."

The above patent and co-pending applications are assigned to the present, assignee and are incorporated herein by reference.

FIELD OF THE INVENTION

The present invention generally relates to inkjet printers and, more particularly, to nozzle or orifice members and other components for the print cartridges used in inkjet printers.

BACKGROUND OF THE INVENTION

Thermal inkjet print cartridges operate by rapidly heating a small volume of ink, causing the ink to vaporize and be ejected through an orifice to strike a recording medium, such as a sheet of paper. When a number of orifices are arranged in a pattern, the properly sequenced ejection of ink from each orifice causes characters or other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and portable.

In one design, the printhead includes: 1) an ink reservoir and ink channels to supply the ink to the point of vaporization proximate to an orifice; 2) an orifice plate in which the individual orifices are formed in the required pattern; and 3) a series of thin film heaters, one below each orifice, formed on a substrate which forms one wall of the ink channels. Each heater includes a thin film resistor and appropriate current leads. To print a single dot of ink, an electrical current from an external power supply is passed through a selected heater. The heater is ohmically heated, in turn superheating a thin layer of the adjacent ink, resulting in explosive vaporization and, consequently, causing a droplet of ink to be ejected through an associated orifice onto the paper.

One prior print cartridge is disclosed in U.S. Pat. No. 4,500,895 to Buck et al., entitled "Disposable Inkjet Head.," issued Feb. 19, 1985 and assigned to the present assignee.

In these printers, print quality depends upon the physical characteristics of the orifices in a printhead incorporated on a print cartridge. For example, the geometry of the orifices in a printhead affects the size, trajectory, and speed of ink drop ejection. In addition, the geometry of the orifices in a printhead can affect the flow of ink supplied to vaporization chambers and, in some instances, can affect the manner in which ink is ejected from adjacent orifices. Orifice plates for inkjet printheads often are formed of nickel and are fabricated by lithographic electroforming processes. One example of a suitable lithographic electroforming process is described in U.S. Pat. No. 4,773,971, entitled "Thin Film Mandrel" and issued to Lam et al. on Sep. 27, 1988. In such processes, the orifices in an orifice plate are formed by overplating nickel around dielectric discs.

Such electroforming processes for forming orifice plates for inkjet printheads have several shortcomings. One shortcoming is that the processes require delicate balancing of parameters such as stress and plating thicknesses, disc diameters, and overplating ratios. Another shortcoming is that such electroforming processes inherently limit design choices for nozzle shapes and sizes.

When using electroformed orifice plates and other components in printheads for inkjet printers, corrosion by the ink can be a problem. Generally speaking, corrosion resistance of such orifice plates depends upon two parameters: ink chemistry and the formation of a hydrated oxide layer on the electroplated nickel surface of an orifice plate. Without a hydrated oxide layer, nickel may corrode in the presence of inks, particularly water-based inks such as are commonly used in inkjet printers. Although corrosion of orifice plates can be minimized by coating the plates with gold, such plating is costly.

Yet another shortcoming of electroformed orifice plates for inkjet printheads is that the completed printheads have a tendency to delaminate during use. Usually, delamination begins with the formation of small gaps between an orifice plate and its substrate, often caused by differences in thermal expansion coefficients of an orifice plate and its substrate. Delamination can be exacerbated by ink interaction with printhead materials. For instance, the materials in an inkjet printhead may swell after prolonged exposure to water-based inks, thereby changing the shape of the printhead internal structure.

Even partial delamination of an orifice plate can result in distorted printing. For example, partial delamination of an orifice plate usually causes decreased or highly irregular ink drop ejection velocities. Also, partial delamination can create accumulation sites for air bubbles that interfere with ink drop ejection.

SUMMARY OF THE INVENTION

A novel nozzle member for an inkjet print cartridge and method of forming the nozzle member are disclosed. In a preferred embodiment, a flexible tape having conductive traces formed thereon has formed in it nozzles or orifices. In a preferred method, the orifices are formed by Excimer laser ablation.

A frequency multiplied YAG laser may also be used in place of the Excimer laser.

The resulting nozzle member having orifices and conductive traces may then have mounted on it a substrate containing heating elements associated with each of the orifices. The conductive traces formed on the back surface of the nozzle member are then connected to the electrodes on the substrate and provide energization signals for the heating elements.

A barrier layer, which may be a separate layer or formed in the nozzle member itself, includes vaporization chambers, surrounding each orifice, and ink flow channels which provide fluid communication between a ink reservoir and the vaporization chambers. The energization of a heating element on the substrate vaporizes ink within an associated vaporization chamber which is then expelled through the orifice in the nozzle member.

By providing the orifices in the flexible circuit itself, the shortcomings of conventional electroformed orifice plates are overcome. Additionally, the orifices may be formed aligned with the conductive traces on the nozzle member so that alignment of electrodes on a substrate with respect to ends of the conductive traces also aligns the heating elements with the orifices.

BRIEF DESCRIPTION OF THE DRAWINGS

The present invention can be further understood by reference to the following description and attached drawings which illustrate the preferred embodiments.

Other features and advantages will be apparent from the following detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
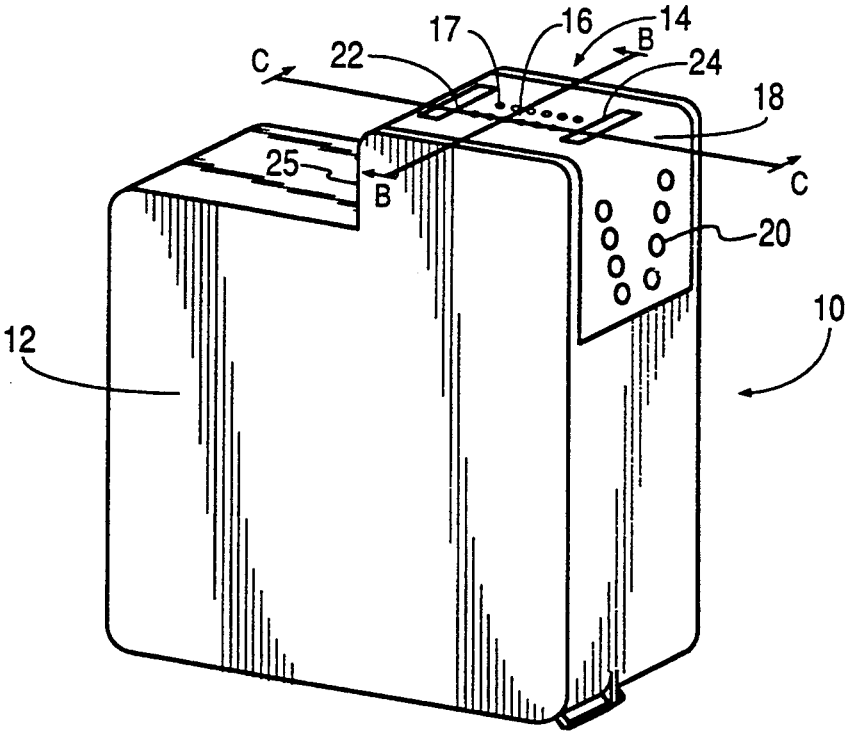
FIG. 1 is a perspective view of an inkjet print cartridge incorporating a printhead in accordance with one embodiment of the present invention.

Referring to FIG. 1, reference numeral 10 generally indicates an inkjet print cartridge incorporating a printhead according to one embodiment of the present invention. The inkjet print cartridge 10 includes an ink reservoir 12 and a printhead 14, where the printhead 14 is formed using Tape Automated Bonding (TAB). The printhead 14 (hereinafter "TAB head assembly 14") includes a nozzle member 16 comprising two parallel columns of offset holes or orifices 17 formed in a flexible polymer tape 18 by, for example, laser ablation. The tape 18 may be purchased commercially as Kapton TM tape, available from 3M Corporation. Other suitable tape may be formed of Upilex TM or its equivalent.

A back surface of the tape 18 includes conductive traces 36 (shown in FIG. 3) formed thereon using a conventional photolithographic etching and/or plating process. These conductive traces are terminated by large contact pads 20 designed to interconnect with a printer. The print cartridge 10 is designed to be installed in a printer so that the contact pads 20, on the front surface of the tape 18, contact: printer electrodes providing externally generated energization signals to the printhead.

In the various embodiments shown, the traces are formed on the back surface of the tape 18 (opposite the surface which faces the recording medium). To access these traces from the front surface of the tape 18, holes (vias) must be formed through the front surface of the tape 18 to expose the ends of the traces. The exposed ends of the traces are then plated with, for example, gold to form the contact pads 20 shown on the front surface of the tape 18.

Windows 22 and 24 extend through the tape 18 and are used to facilitate bonding of the other ends of the conductive traces to electrodes on a silicon substrate containing heater resistors. The windows 22 and 24 are filled with an encapsulant to protect any underlying portion of the traces and substrate.

In the print cartridge 10 of FIG. 1, the tape 18 is bent over the back edge of the print cartridge "snout" and extends approximately one half the length of the back wall 25 of the snout. This flap portion of the tape 18 is needed for the routing of conductive traces which are connected to the substrate electrodes through the far end window 22.

Figure 2:
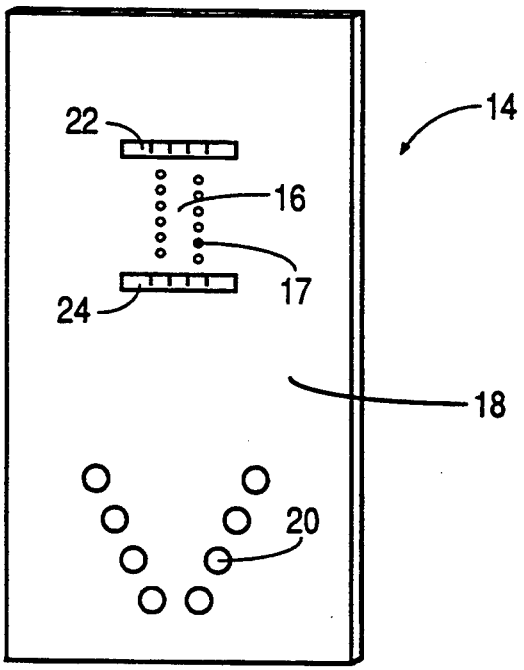
FIG. 2 is a perspective view of the front surface of the Tape Automated Bonding (TAB) printhead assembly (hereinafter called "TAB head assembly") removed from the print cartridge of FIG. 1.

FIG. 2 shows a front view of the TAB head assembly 14 of FIG. 1 removed from the print cartridge 10 and prior to windows 22 and 24 in the TAB head assembly 14 being filled with an encapsulant.

Affixed to the back of the TAB head assembly 14 is a silicon substrate 28 (Shown in FIG. 3) containing a plurality of individually energizable thin film resistors. Each resistor is located generally behind a single orifice 17 and acts as an ohmic heater when selectively energized by one or more pulses applied sequentially or simultaneously to one or more of the contact pads 20.

The orifices 17 and conductive traces may be of any size, number, and pattern, and the various figures are designed to simply and clearly show the features of the invention. The relative dimensions of the various features have been greatly adjusted for the sake of clarity.

The orifice pattern on the tape 18 shown in FIG. 2 may be formed by a masking process in combination with a laser or other etching means in a step-and-repeat process, which would be readily understood by one of ordinary skilled in the art after reading this disclosure.

Figure 12:
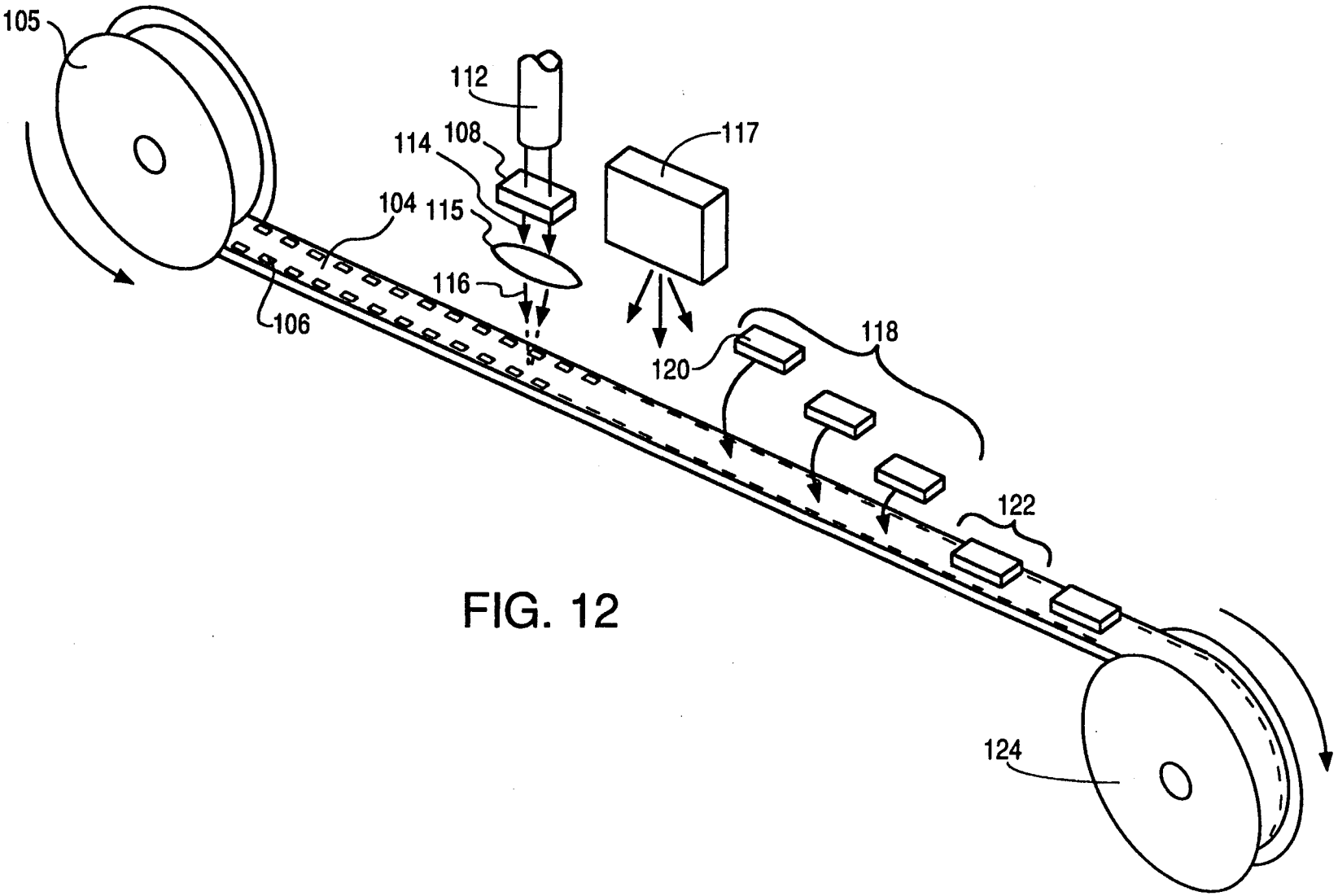
FIG. 12 illustrates one process which may be used to form any of the TAB head assemblies described herein.

FIG. 12, to be described in detail later, provides additional detail of this process.

Figure 3:
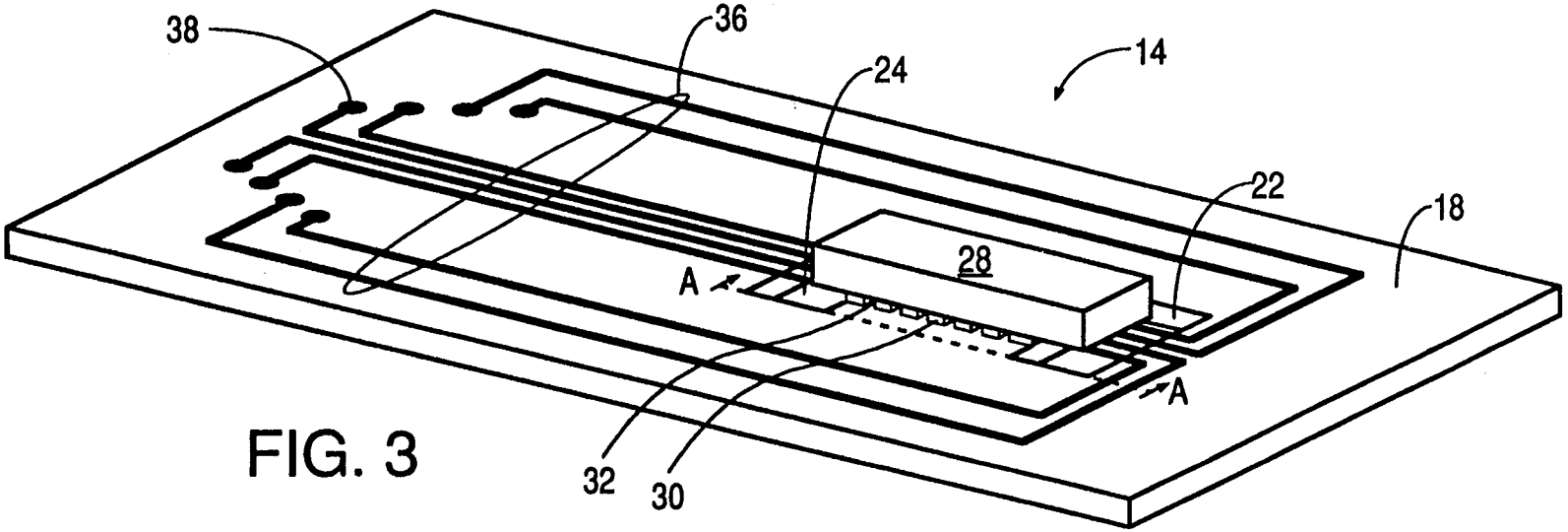
FIG. 3 is a perspective view of the back surface of the TAB head assembly of FIG. 2 with a silicon substrate mounted thereon and the conductive leads attached to the substrate.
Figure 6:
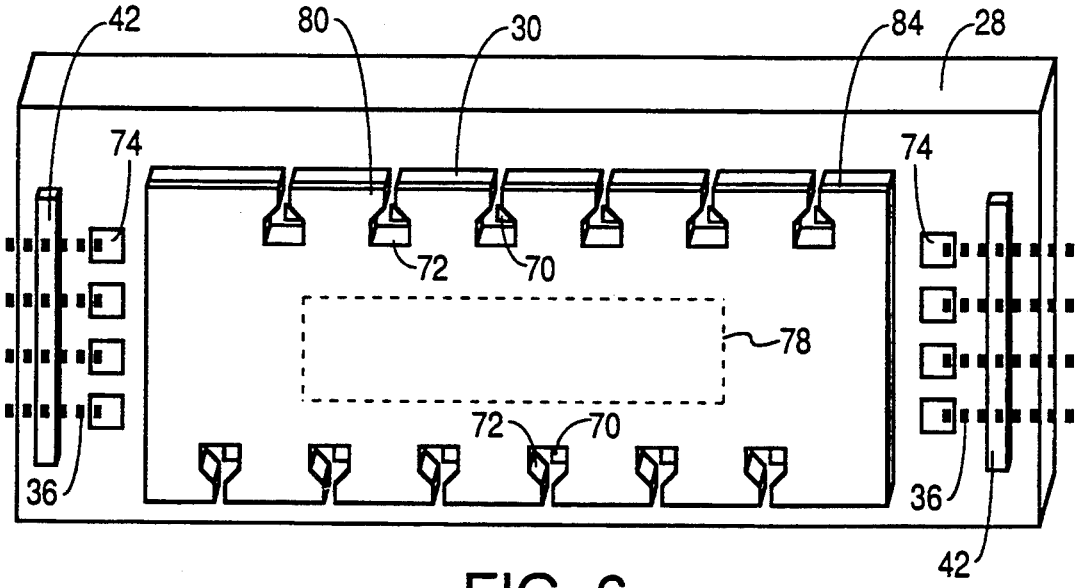
FIG. 6 is a top plan view, in perspective, of a substrate structure containing heater resistors, ink channels, and vaporization chambers, which is mounted on the back of the TAB head assembly of FIG. 2.

FIG. 3 shows a back surface of the TAB head assembly 14 of FIG. 2 showing the silicon die or substrate 28 mounted to the back of the tape 18 and also showing one edge of a barrier layer 30 formed on the substrate 28 containing ink channels and vaporization chambers. FIG. 6 shows greater detail of this barrier layer 30 and will be discussed later. Shown along the edge of the barrier layer 30 are the entrances of the ink channels 32 which receive ink from the ink reservoir 12 (FIG. 1).

The conductive traces 36 formed on the back of the tape 18 are also shown in FIG. 3, where the traces 36 terminate in contact pads 20 (FIG. 2) on the opposite side of the tape 18.

The windows 22 and 24 allow access to the ends of the traces 36 and the substrate electrodes from the other side of the tape 18 to facilitate bonding.

Figure 4:
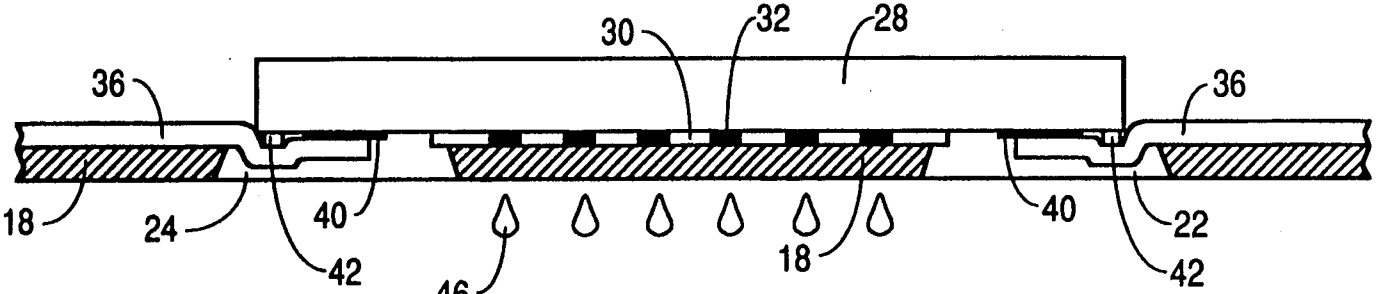
FIG. 4 is a side elevational view in cross-section taken along line A—A in FIG. 3 illustrating the attachment of conductive leads to electrodes on the silicon substrate.

FIG. 4 shows a side view cross-section taken along line A—A in FIG. 3 illustrating the connection of the ends of the conductive traces 36 to the electrodes 40 formed on the substrate 28. As seen in FIG. 4, a portion 42 of the barrier layer 30 is used to insulate the ends of the conductive traces 36 from the substrate 28.

Also shown in FIG. 4 is a side view of the tape 18, the barrier layer 30, the windows 22 and 24, and the entrances of the various ink channels 32. Droplets 46 of ink are shown being ejected from orifice holes associated with each of the ink channels 32.

Figure 5:
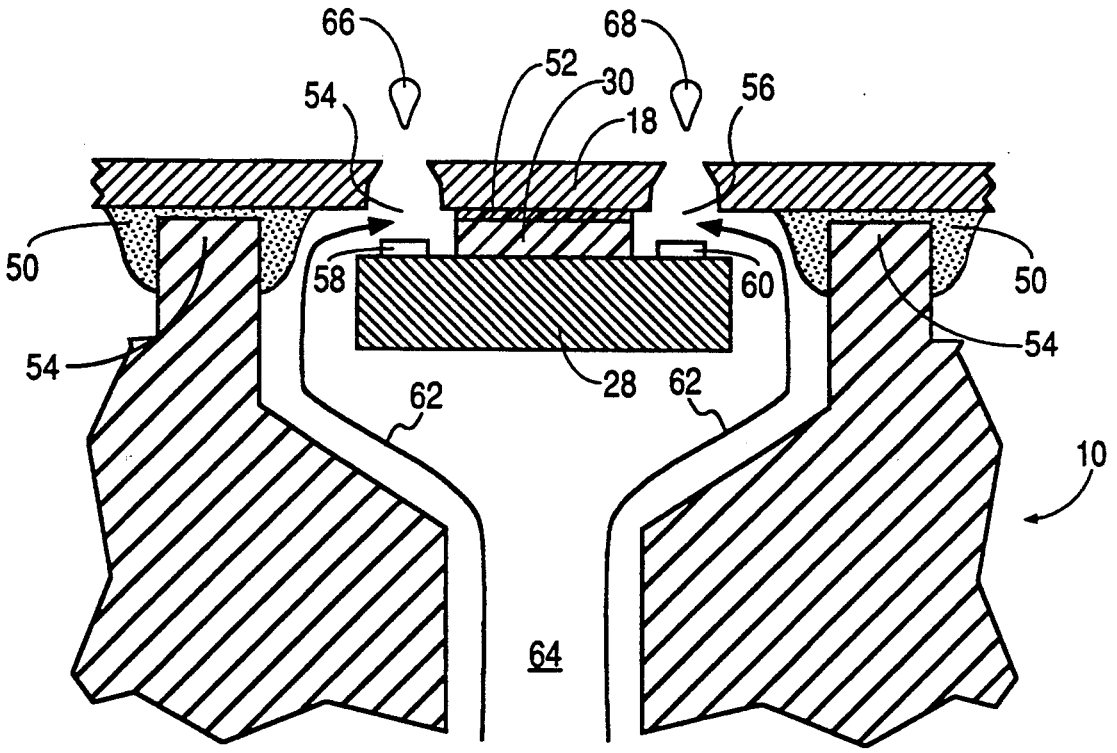
FIG. 5 is a schematic cross-sectional view taken along line B—B of FIG. 1 showing the seal between the TAB head assembly and the print cartridge as well as the ink flow path around the edges of the substrate.

The back surface of the TAB assembly 14 in FIG. 3 is sealed, as shown in FIG. 5, with respect to an ink opening in the ink reservoir 12 by an adhesive seal which circumscribes the substrate 28 and forms an ink seal between the back surface of the tape 18 and the ink reservoir 12.

Shown in FIG. 5 is a side elevational view in cross-section taken along line B—B in FIG. 1 showing a portion of the adhesive seal 50 surrounding the substrate 28 and showing the substrate 28 being adhesively secured to a central portion of the tape 18 by a thin adhesive layer 52 on the top surface of the barrier layer 30 containing the ink channels and vaporization chambers 54 and 56. A portion of the plastic body of the printhead cartridge 10 is also shown. Thin film resistors 58 and 60 are shown within the vaporization chambers 54 and 56, respectively.

FIG. 5 also illustrates how ink 62 from the ink reservoir 12 flows through the central slot 64 formed in the print cartridge 10 and flows around the edges of the substrate 28 into the vaporization chambers 54 and 56. When the resistors 58 and 60 are energized, a portion of the ink within the vaporization chambers 54 and 56 is ejected, as illustrated by the emitted drops of ink 66 and 68.

FIG. 6 is a front top plan view, in perspective, of the silicon substrate 28 which is affixed to the back of the tape 18 in FIG. 2 to form the TAB head assembly 14.

Silicon substrate 28 has formed on it, using conventional photolithographic techniques, two rows of thin film resistors 70, shown in FIG. 6 exposed through the vaporization chambers 72 formed in the barrier layer 30.

In one embodiment, the substrate 28 is approximately one-half inch long and contains 300 heater resistors 70, thus enabling a resolution of 600 dots per inch.

Also formed on the substrate 28 are electrodes 74 for connection to the conductive traces 36 (shown by dashed lines) formed on the back of the tape 18 in FIG. 2.

A demultiplexer 78, shown by a dashed outline in FIG. 6, is also formed on the substrate 28 for demultiplexing the incoming multiplexed signals applied to the electrodes 74 and distributing the signals to the various thin film resistors 70. The demultiplexer 78 enables the use of much fewer electrodes 74 than thin film resistors 70. The demultiplexer 78 may be any decoder for decoding encoded signals applied to the electrodes 74.

Also formed on the surface of the substrate 28 using conventional photolithographic techniques is the barrier layer 30, which may be a layer of photoresist or some other polymer, in which is formed the vaporization chambers 72 and ink channels 80.

A portion 42 of the barrier layer 30 insulates the conductive traces 36 from the underlying substrate 28, as previously discussed with respect to FIG. 4.

In order to adhesively affix the top surface of the barrier layer 30 to the back surface of the tape 18 shown in FIG. 3, a thin adhesive layer 84, such as an uncured layer of photoresist, is applied to the top surface of the barrier layer 30. A separate adhesive layer may not be necessary if the top of the barrier layer 30 can be otherwise made adhesive. The resulting substrate structure is then positioned with respect to the back surface of the tape 18 so as to align the resistors 70 with the orifices formed in the tape 18. This alignment step also inherently aligns the electrodes 74 with the ends of the conductive traces 36. The traces 36 are then bonded to the electrodes 74. This alignment and bonding process is described in more detail later with respect to FIG. 12. The aligned and bonded substrate/tape structure is then heated while applying pressure to cure the adhesive layer 84 and firmly affix the substrate structure to the back surface of the tape 18.

Figure 7:
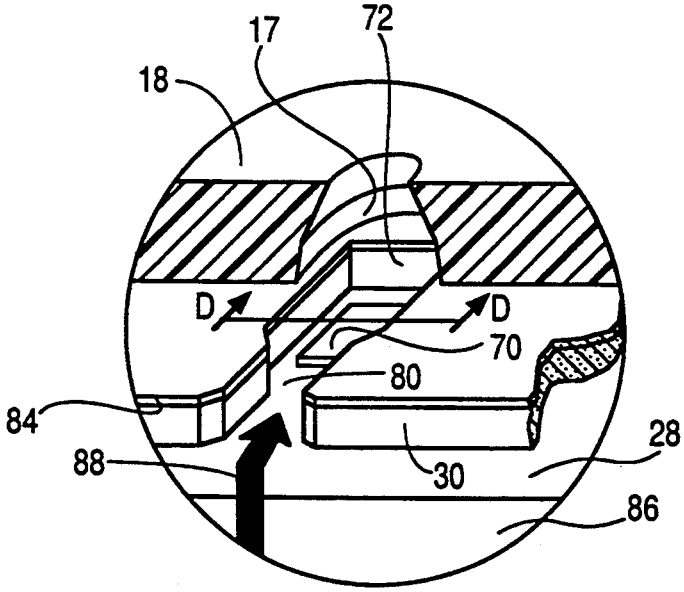
FIG. 7 is a top plan view, in perspective, partially cut away, of a portion of the TAB head assembly showing the relationship of an orifice with respect to a vaporization chamber, a heater resistor, and an edge of the substrate.

FIG. 7 is an enlarged view of a single vaporization chamber 72, thin film resistor 70, and orifice 17 after the substrate structure of FIG. 6 is secured to the back of the tape 18 via the thin adhesive layer 84. A side edge of the substrate 28 is shown as edge 86. In operation, ink flows from the ink reservoir 12 in FIG. 1, around the side edge 86 of the substrate 28, and into the ink channel 80 and associated vaporization chamber 72, as shown by the arrow 88. Upon energization of the thin film resistor 70, a thin layer of the adjacent ink is superheated, causing explosive vaporization and, consequently, causing a droplet of ink to be ejected through the orifice 17. The vaporization chamber 72 is then refilled by capillary action.

In a preferred embodiment, the barrier layer 30 is approximately 1 mils thick, the substrate 28 is approximately 20 mils thick, and the tape 18 is approximately 2 mils thick.

Figure 8:
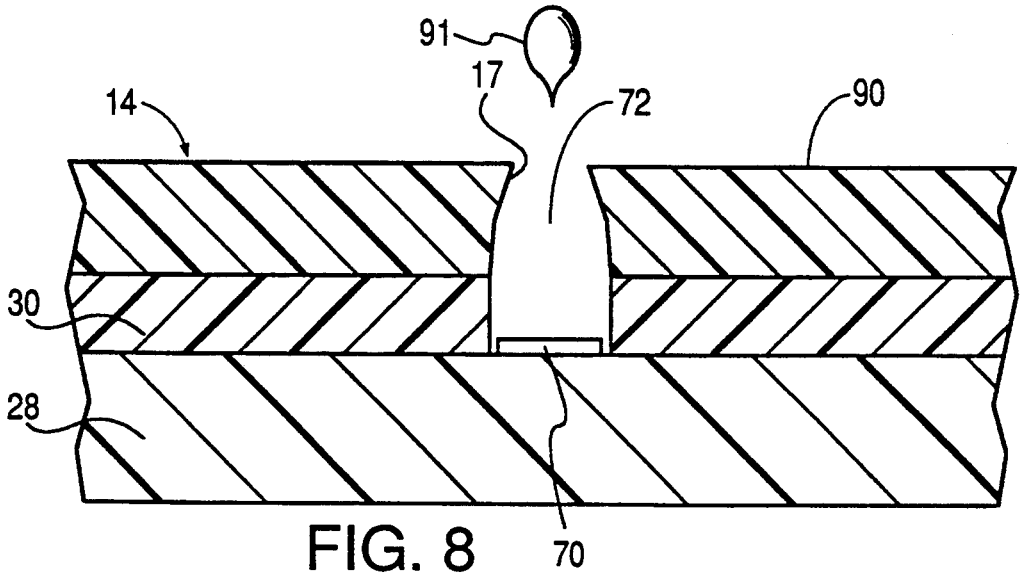
FIG. 8 is a side elevational view, in cross-section and partially cut away, taken along line D—D of FIG. 7 of the ink ejection chamber of FIG. 7.

FIG. 8 is a side elevational view in cross-section taken along line C—C in FIG. 1 of one ink ejection chamber in the TAB head assembly 14 in accordance with one embodiment of the invention. The cross-section shows a laser-ablated polymer nozzle member 90 laminated to a barrier layer 30, which may be similar to that shown in FIG. 6. When the thin film resistor 70 on the substrate 28 is energized, a portion of the ink within the vaporization chamber 72 is vaporized, and an ink droplet 91 is expelled through the orifice 17.

Figure 9:
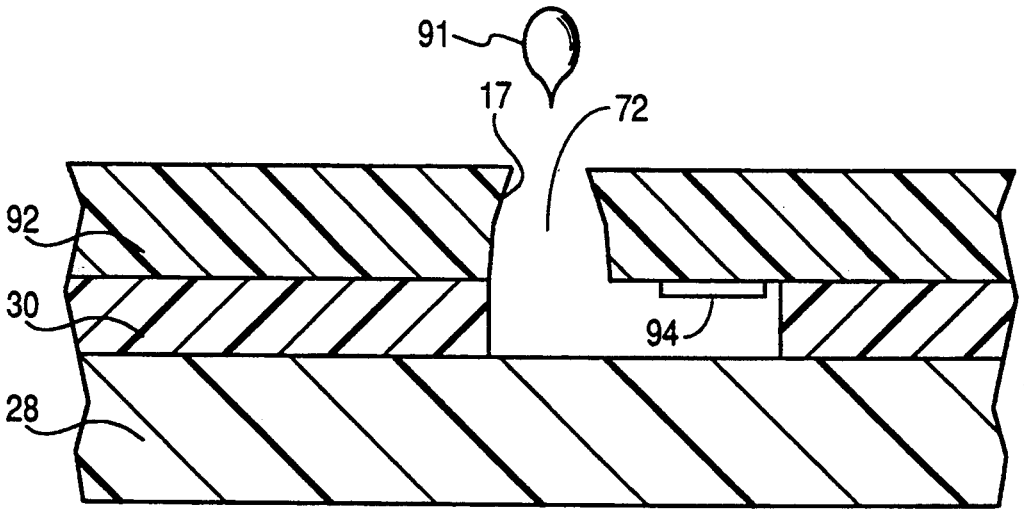
FIG. 9 is a side elevational view, in cross-section and partially cut away, of an ink ejection chamber where a heater element is located on the nozzle member.

FIG. 9 is a side elevational view in cross-section of an alternative embodiment of an ink ejection chamber using a polymer, laser-ablated nozzle member 92. As in the above-described embodiments, a vaporization chamber 72 is bounded by the nozzle member 92, the substrate 28, and the barrier layer 30. In contrast to the above-described embodiments, however, a heater resistor 94 is mounted on the undersurface of the nozzle member 92, not on the substrate 28. This enables a simpler construction of the printhead.

Conductive traces (such as shown in FIG. 3) formed on the bottom surface of the nozzle member 92 provide electrical signals to the resistors 94.

The various vaporization chambers discussed herein can also be formed by laser-ablation in a manner similar to forming the nozzle member. More particularly, vaporization chambers of selected configurations can be formed by placing a lithographic mask over a layer of polymer, such as a polymer tape, and then laser-ablating the polymer layer with the laser light in areas that are unprotected by the lithographic mask. In practice, the polymer layer containing the vaporization chambers can be bonded to, be formed adjacent to, or be a unitary part of a nozzle member.

Figure 10:
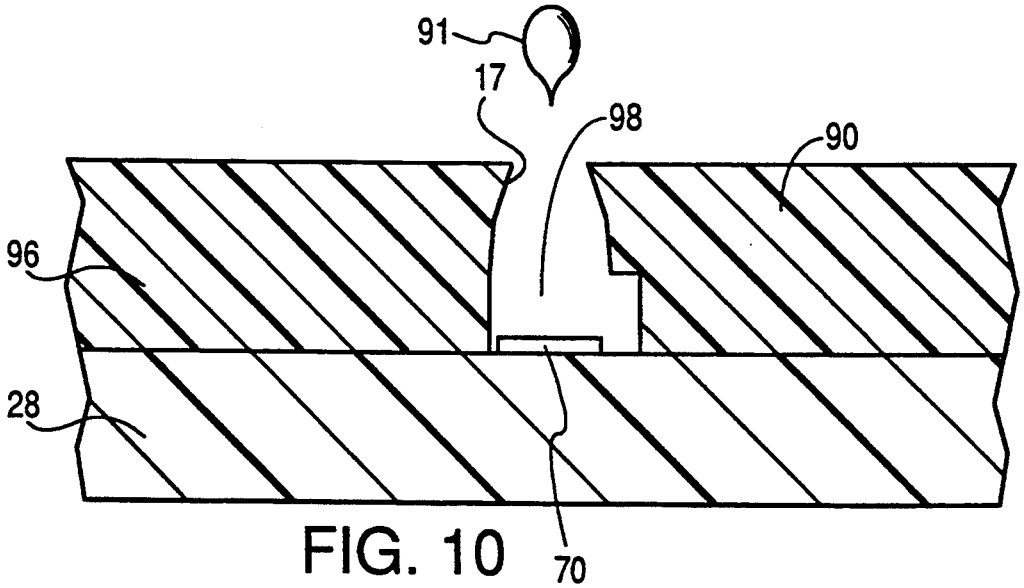
FIG. 10 is a side elevational view, in cross-section and partially cut away, taken along line E—E of FIG. 11 of an ink ejection chamber formed in the tape of FIG. 11 where the nozzle member itself includes ink channels and vaporization chambers. (The substrate is not shown in FIG. 11 for clarity.)

FIG. 10 is a side elevational view in cross-section of a nozzle member 96 having orifices, ink channels, and vaporization chambers 98 laser-ablated in a same polymer layer. The formation of vaporization chambers by laser ablation as a unitary part of a nozzle member, as shown in FIG. 10, is greatly assisted by the property of laser ablation of forming a recessed chamber with a substantially flat bottom, provided the optical energy density of the incident laser beam is constant across the region being ablated. The depth of such chambers is determined by the number of laser shots, and the energy density of each.

If the resistor, such as the resistor 70 in FIG. 10, is formed on the nozzle member 96 itself, the substrate 28 may be eliminated altogether.

Figure 11:
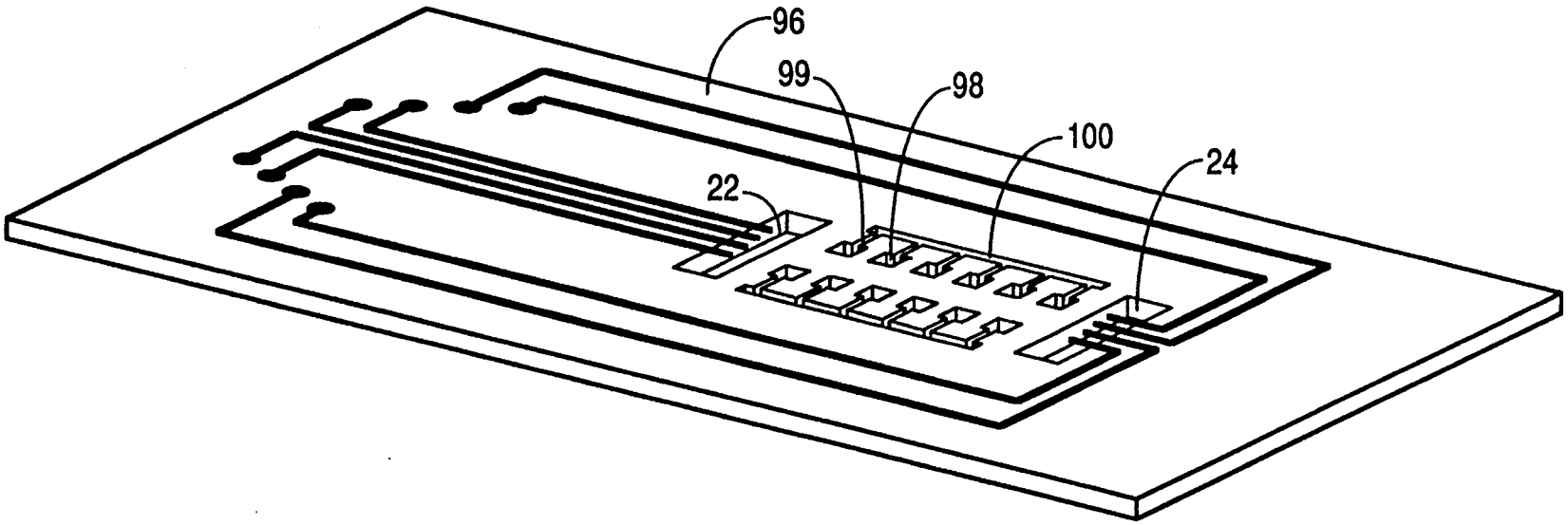
FIG. 11 is a perspective view of the back surface of an embodiment of the TAB head assembly where the back surface of the tape has ink channels and vaporization chambers formed therein.

FIG. 11 shows the back surface of the nozzle member 96 in FIG. 10 prior to a substrate being affixed thereon. The vaporization chambers 98, ink channels 99, and ink manifolds 100 are formed part way through the thickness of the nozzle member 96, while orifices, such as the orifices 17 shown in FIG. 2, are formed completely through the thickness of the nozzle member 96. Ink from an ink reservoir flows around the sides of a substrate (not shown) mounted on the back surface of the nozzle member 96, then into the ink manifolds 100, and then into the ink channels 99 and vaporization chambers 98. The windows 22 and 24, used for bonding as previously discussed, are also shown.

Multiple lithographic masks may be used to form the orifice and ink path patterns in the unitary nozzle member 96.

FIG. 12 illustrates a method for forming either the embodiment of the TAB head assembly 14 in FIG. 3 or the TAB head assembly formed using the nozzle member 96 in FIG. 11.

The starting material is a Kapton TM or Upilex TM-type polymer tape 104, although the tape 104 can be any suitable polymer film which is acceptable for use in the below-described procedure. Some such films may comprise teflon, polyimide, polymethylmethacrylate, polycarbonate, polyester, polyamide, polyethylene-terephthalate or mixtures thereof.

The tape 104 is typically produced in long strips on a reel 105. Sprocket holes 106 along the sides of the tape 104 are used to accurately and securely transport the tape 104. Alternately, the sprocket holes 106 may be omitted and the tape may be transported with other types of fixtures.

In the preferred embodiment, the tape 104 is already provided with conductive copper traces 36, such as shown in FIG. 3, formed thereon using conventional photolithographic and metal deposition processes. The particular pattern of conductive traces depends on the manner in which it is desired to distribute electrical signals to the electrodes formed on silicon dies, which are subsequently mounted on the tape 104.

In the preferred process, the tape 104 is transported to a laser processing chamber and laser-ablated in a pattern defined by one or more masks 108 using laser radiation 110, such as that generated by an Excimer laser 112 of the $F_2$, ArF, KrCl, KrF, or XeCl type. The masked laser radiation is designated by arrows 114.

In a preferred embodiment, such masks 108 define all of the ablated features for an extended area of the tape 104, for example encompassing multiple orifices in the case of an orifice pattern mask 108, and multiple vaporization chambers in the case of a vaporization chamber pattern mask 108. Alternatively, patterns such as the orifice pattern, the vaporization chamber pattern, or other patterns may be placed side by side on a common mask substrate which is substantially larger than the laser beam. Then such patterns may be moved sequentially into the beam. The masking material used in such masks will preferably be highly reflecting at the laser wavelength, consisting of, for example, a multilayer dielectric or a metal such as aluminum.

The orifice pattern defined by the one or more masks 108 may be that generally shown in FIG. 2. Multiple masks 108 may be used to form a stepped orifice taper as shown in FIGS. 8–10.

In one embodiment, a separate mask 108 defines the pattern of windows 22 and 24 shown in FIGS. 2 and 3; however, in the preferred embodiment, the windows 22 and 24 are formed using conventional photolithographic methods prior to the tape 104 being subjected to the processes shown in FIG. 12.

In the embodiment of FIGS. 10 and 11, where the nozzle member also includes vaporization chambers, one or more masks 108 would be used to form the orifices and another mask 108 and laser energy level (and/or number of laser shots) would be used to-define the vaporization chambers, ink channels, and manifolds which are formed through a portion of the thickness of the tape 104.

The laser system for this process generally includes beam delivery optics, alignment optics, a high precision and high speed mask shuttle system, and a processing chamber including a mechanism for handling and positioning the tape 104. In the preferred embodiment, the laser system uses a projection mask configuration wherein a precision lens 115 interposed between the mask 108 and the tape 104 projects the Excimer laser light onto the tape 104 in the image of the pattern defined on the mask 108.

The masked laser radiation exiting from lens 115 is represented by arrows 116.

Such a projection mask configuration is advantageous for high precision orifice dimensions, because the mask is physically remote from the nozzle member. Soot is naturally formed and ejected in the ablation process, traveling distances of about one centimeter from the nozzle member being ablated. If the mask were in contact with the nozzle member, or in proximity to it, soot buildup on the mask would tend to distort ablated features and reduce their dimensional accuracy. In the preferred embodiment, the projection lens is more than two centimeters from the nozzle member being ablated, thereby avoiding the buildup of any soot on it or on the mask.

Ablation is well known to produce features with tapered walls, tapered so that the diameter of an orifice is larger at the surface onto which the laser is incident, and smaller at the exit surface. The taper angle varies significantly with variations in the optical energy density incident on the nozzle member for energy densities less than about two joules per square centimeter. If the energy density were uncontrolled, the orifices produced would vary significantly in taper angle, resulting in substantial variations in exit orifice diameter. Such variations would produce deleterious variations in ejected ink drop volume and velocity, reducing print quality. In the preferred embodiment, the optical energy of the ablating laser beam is precisely monitored and controlled to achieve a consistent taper angle, and thereby a reproducible exit diameter. In addition to the print quality benefits resulting from the constant orifice exit diameter, a taper is beneficial to the operation of the orifices, since the taper acts to increase the discharge speed and provide a more focused ejection of ink, as well as provide other advantages. The taper may be in the range of 5 to 15 degrees relative to the axis of the orifice. The preferred embodiment process described herein allows rapid and precise fabrication without a need to rock the laser beam relative to the nozzle member. It produces accurate exit diameters even though the laser beam is incident on the entrance surface rather than the exit surface of the nozzle member.

After the step of laser-ablation, the polymer tape 104 is stepped, and the process is repeated. This is referred to as a step-and-repeat process. The total processing time required for forming a single pattern on the tape 104 may be on the order of a few seconds. As mentioned above, a single mask pattern may encompass an extended group of ablated features to reduce the processing time per nozzle member.

Laser ablation processes have distinct advantages over other forms of laser drilling for the formation of precision orifices, vaporization chambers, and ink channels. In laser ablation, short pulses of intense ultraviolet light are absorbed in a thin surface layer of material within about 1 micrometer or less of the surface. Preferred pulse energies are greater than about 100 millijoules per square centimeter and pulse durations are shorter than about 1 microsecond. Under these conditions, the intense ultraviolet light photodissociates the chemical bonds in the material. Furthermore, the absorbed ultraviolet energy is concentrated in such a small volume of material that it rapidly heats the dissociated fragments and ejects them away from the surface of the material. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micrometer. In addition, laser ablation can also form chambers with substantially flat bottom surfaces which form a plane recessed into the layer, provided the optical energy density is constant across the region being ablated. The depth of such chambers is determined by the number of laser shots, and the power density of each.

Laser-ablation processes also have numerous advantages as compared to conventional lithographic electroforming processes for forming nozzle members for inkjet printheads. For example, laser-ablation processes generally are less expensive and simpler than conventional lithographic electroforming processes. In addition, by using laser-ablations processes, polymer nozzle members can be fabricated in substantially larger sizes (i.e., having greater surface areas) and with nozzle geometries that are not practical with conventional electroforming processes. In particular, unique nozzle shapes can be produced by controlling exposure intensity or making multiple exposures with a laser beam being reoriented between each exposure. Examples of a variety of nozzle shapes are described in copending application Ser. No. 07/658726, entitled "A Process of Photo-Ablating at Least One Stepped Opening Extending Through a Polymer Material, and a Nozzle Plate Having Stepped Openings," assigned the present assignee and incorporated herein by reference. Also, precise nozzle geometries can be formed without process controls as strict as those required for electroforming processes.

Another advantage of forming nozzle members by laser-ablating a polymer material is that the orifices or nozzles can be easily fabricated with ratios of nozzle length (L) to nozzle diameter (D) greater than conventional. In the preferred embodiment, the L/D ratio exceeds unity. One advantage of extending a nozzle's length relative to its diameter is that orifice-resistor positioning in a vaporization chamber becomes less critical.

In use, laser-ablated polymer nozzle members for inkjet printers have characteristics that are superior to conventional electroformed orifice plates. For example, laser-ablated polymer nozzle members are highly resistant to corrosion by water-based printing inks and are generally hydrophobic. Further, laser-ablated polymer nozzle members have a relatively low elastic modulus, so built-in stress between the nozzle member and an underlying substrate or barrier layer has less of a tendency to cause nozzle member-to-barrier layer delamination. Still further, laser-ablated polymer nozzle members can be readily fixed to, or formed with, a polymer substrate.

Although an Excimer laser is used in the preferred embodiments, other ultraviolet light sources with substantially the same .optical wavelength and energy density may be used to accomplish the ablation process. Preferably, the wavelength of such an ultraviolet light source will lie in the 150 nm to 400 nm range to allow high absorption in the tape to be ablated. Furthermore, the energy density should be greater than about 100 millijoules per square centimeter with a pulse length shorter than about 1 microsecond to achieve rapid ejection of ablated material with essentially no heating of the surrounding remaining material.

As will be understood by those of ordinary skill in the art, numerous other processes for forming a pattern on the tape 104 may also be used. Other such processes include chemical etching, stamping, reactive ion etching, ion beam milling, and molding or casting on a photo-defined pattern.

A next step in the process is a cleaning step wherein the laser ablated portion of the tape 104 is positioned under a cleaning station 117. At the cleaning station 117, debris from the laser ablation is removed according to standard industry practice.

The tape 104 is then stepped to the next station, which is an optical alignment station 11.8 incorporated in a conventional automatic TAB bonder, such as an inner lead bonder commercially available from Shinkawa Corporation, model number IL-20. The bonder is preprogrammed with an alignment (target) pattern on the nozzle member, created in the same manner and/or step as used to created the orifices, and a target pattern on the substrate, created in the same manner and/or step used to create the resistors. In the preferred embodiment, the nozzle member material is semi-transparent so that the target pattern on the substrate may be viewed through the nozzle member. The bonder then automatically positions the silicon dies 120 with respect to the nozzle members so as to align the two target patterns. Such an alignment feature exists in the Shinkawa TAB bonder. This automatic alignment of the nozzle member target pattern with the substrate target pattern not only precisely aligns the orifices with the resistors but also inherently aligns the electrodes on the dies 120 with the ends of the conductive traces formed in the tape 104, since the traces and the orifices are aligned in the tape 104, and the substrate electrodes and the heating resistors are aligned on the substrate. Therefore, all patterns on the tape 104 and on the silicon dies 120 will be aligned with respect to one another once the two target patterns are aligned.

Thus, the alignment of the silicon dies 120 with respect to the tape 104 is performed automatically using only commercially available equipment. By integrating the conductive traces with the nozzle member, such an alignment feature is possible. Such integration not only reduces the assembly cost of the printhead but reduces the printhead material cost as well.

The automatic TAB bonder then uses a gang bonding method to press the ends of the conductive traces down onto the associated substrate electrodes through the windows formed in the tape 104. The bonder then applies heat, such as by using thermocompression bonding, to weld the ends of the traces to the associated electrodes. A side view of one embodiment of the resulting structure is shown in FIG. 4. Other types of bonding can also be used, such as ultrasonic bonding, conductive epoxy, solder paste, or other well-known means.

The tape 104 is then stepped to a heat and pressure station 122. As previously discussed with respect to FIGS. 6 and 7, an adhesive layer 84 exists on the top surface of the barrier layer 30 formed on the silicon substrate. After the above-described bonding step, the silicon dies 120 are then pressed down against the tape 104, and heat is applied to cure the adhesive layer 84 and physically bond the dies 120 to the tape 104.

Thereafter the tape 104 steps and is optionally taken up on the take-up reel 124. The tape 104 may then later be cut to separate the individual TAB head assemblies from one another.

The resulting TAB head assembly is then positioned on the print cartridge 10, and the previously described adhesive seal 50 in FIG. 5 is formed to firmly secure the nozzle member to the print cartridge, provide an inkproof seal around the substrate-between the nozzle member and the ink reservoir, and encapsulate the traces extending from the substrate so as to isolate the traces from the ink.

Peripheral points on the flexible TAB head assembly are then secured to the plastic print cartridge 10 by a conventional melt-through type bonding process to cause the polymer tape 18 to remain relatively flush with the surface of the print cartridge 10, as shown in FIG. 1.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A process for forming an inkjet printhead for a printer, comprising the steps of:

forming ink orifices in a unitary strip of insulating flexible tape containing conductors for conducting electrical signals to ink ejection elements, said flexible tape having said orifices formed therein being a nozzle member for said printhead, said conductors extending from an area on said tape proximate to said orifices to a remote area on said tape for connection to power supply terminals in an ink printer; and providing said ink injection elements proximate to each of said orifices and connected to said conductors to form said printhead.

2. The process of claim 1 wherein said step of forming ink orifices comprises laser ablating said flexible tape in a desired orifice pattern.

3. The process of claim 1 wherein said flexible tape comprises a polymer material.

4. The process of claim 1 wherein said step of forming ink orifices comprises the steps of:

providing a first masking means between a laser and said tape, said first masking means including a pattern corresponding to said ink orifices; and exposing said tape to laser radiation through said first masking means.

5. The process of claim 1 wherein a plurality of nozzle members, each nozzle member to be subsequently mounted onto an associated print cartridge, are formed on a single flexible tape using a step-and-repeat process.

6. The process of claim 1 wherein said step of providing ink ejection elements comprises the step of:

attaching a substrate containing a plurality of heater resistors to a bottom surface of said nozzle member, each of said heater resistors being associated with one of said ink orifices.

* * * * *

UNITED STATES PATENT AND TRADEMARK OFFICE

CERTIFICATE OF CORRECTION

PATENT NO. : 5,442,384

DATED : August 15, 1995

INVENTOR(S) : Schantz et al.

It is certified that error appears in the above-identified patent and that said Letters Patent is hereby corrected as shown below:

On cover page at [75] Inventors:, delete "Si Ty, Pleassanton" and substitute --Si-Ty Lam, Pleasanton--.

Signed and Sealed this

Fourteenth Day of November, 1995

*Attest:*

*Attesting Officer*

BRUCE LEHMAN

*Commissioner of Patents and Trademarks*